US009334691B2

(12) United States Patent
Jarvis et al.

(10) Patent No.: US 9,334,691 B2
(45) Date of Patent: May 10, 2016

(54) APPARATUS AND METHOD FOR CONTROLLING OR LIMITING ROTOR ORBIT IN MOVING CAVITY MOTORS AND PUMPS

(75) Inventors: Brian P. Jarvis, Bristol (GB); Nigel Wilcox, Bristol (GB); Brian Williams, Bristol (GB); Lance Underwood, Cypress, TX (US); William Murray, Tomball, TX (US); Peter Thomas Cariveau, Spring, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 526 days.

(21) Appl. No.: 13/300,446

(22) Filed: Nov. 18, 2011

(65) Prior Publication Data

US 2012/0132470 A1 May 31, 2012

(30) Foreign Application Priority Data

Nov. 19, 2010 (GB) ..... 1019614.5

(51) Int. Cl.

| | |
|---|---|
| ***F03C 2/08*** | (2006.01) |
| ***F04C 2/107*** | (2006.01) |
| ***F04C 13/00*** | (2006.01) |
| ***E21B 4/02*** | (2006.01) |

(52) U.S. Cl.

CPC ... *E21B 4/02* (2013.01); *F03C 2/08* (2013.01); *F04C 2/1071* (2013.01); *F04C 2/1075* (2013.01); *F04C 13/008* (2013.01); *F04C 2240/80* (2013.01); *Y10T 29/49242* (2015.01)

(58) Field of Classification Search

CPC ..... E21B 4/02; F03C 2/08; F04C 13/008; F04C 2/1071; F04C 2/1075

USPC ..... 418/48, 49, 50, 51, 153, 152, 156

See application file for complete search history.

(56) References Cited

U.S. PATENT DOCUMENTS

| | | | | | |
|---|---|---|---|---|---|
| 2,527,670 | A | * | 10/1950 | Allen | 418/48 |
| 3,627,453 | A | * | 12/1971 | Clark | 418/48 |
| 4,080,115 | A | * | 3/1978 | Sims et al. | 418/48 |
| 4,311,443 | A | * | 1/1982 | Clark et al. | 418/48 |
| 4,397,619 | A | | 8/1983 | Alliquander et al. | |
| 4,415,316 | A | | 11/1983 | Jurgens | |
| 4,824,258 | A | * | 4/1989 | Bodine | 418/48 |
| 4,923,376 | A | | 5/1990 | Wright | |
| 5,209,294 | A | | 5/1993 | Weber | |
| 5,248,896 | A | | 9/1993 | Forrest | |

(Continued)

FOREIGN PATENT DOCUMENTS

| | | | |
|---|---|---|---|
| CN | 1216596 | A | 5/1999 |
| CN | 102386693 | A | 3/2012 |

(Continued)

OTHER PUBLICATIONS

Search Report issued Mar. 22, 2011in related UK application No. GB1019614.5 (4 pages).

(Continued)

*Primary Examiner* — Mary A Davis

(74) *Attorney, Agent, or Firm* — Kimberly Ballew

(57) ABSTRACT

A moving cavity motor or pump, such as a mud motor, comprising: a rotor, a stator, and one or more apparatus for constraining (i.e., controlling or limiting) the movement of the rotor relative to the stator.

25 Claims, 7 Drawing Sheets

(56) References Cited

U.S. PATENT DOCUMENTS

| | | | | |
|---|---|---|---|---|
| 5,318,416 | A | 6/1994 | Hantschk et al. | |
| 5,549,464 | A * | 8/1996 | Varadan | 418/48 |
| 5,759,019 | A | 6/1998 | Wood et al. | |
| 6,241,494 | B1 | 6/2001 | Pafitis et al. | |
| 6,336,502 | B1 * | 1/2002 | Surjaatmadja et al. | 166/104 |
| 6,336,796 | B1 | 1/2002 | Cholet et al. | |
| 6,358,027 | B1 | 3/2002 | Lane | |
| 6,461,128 | B1 | 10/2002 | Wood | |
| 6,543,132 | B1 | 4/2003 | Krueger et al. | |
| 7,074,018 | B2 * | 7/2006 | Chang | 418/48 |
| 7,465,157 | B2 * | 12/2008 | Weber | F04C 2/1071 418/48 |
| 2002/0074167 | A1 | 6/2002 | Plop | |
| 2005/0008509 | A1 | 1/2005 | Chang | |
| 2006/0182644 | A1 | 8/2006 | Delpassand et al. | |
| 2007/0140883 | A1 | 6/2007 | Lievestro et al. | |
| 2009/0152009 | A1 | 6/2009 | Slay et al. | |
| 2010/0038142 | A1 | 2/2010 | Snyder et al. | |
| 2010/0040498 | A1 * | 2/2010 | Akamatsu | F04C 2/1073 418/48 |
| 2010/0092317 | A1 | 4/2010 | Suhara et al. | |
| 2011/0116960 | A1 | 5/2011 | Akbari et al. | |
| 2013/0048384 | A1 | 2/2013 | Jarvis et al. | |

FOREIGN PATENT DOCUMENTS

| | | | |
|---|---|---|---|
| EP | 280294 | B1 | 8/1992 |
| EP | 2113667 | A1 | 11/2009 |
| FR | 2794498 | A1 | 12/2000 |
| GB | 699438 | A | 11/1953 |
| GB | 2076471 | A | 12/1981 |
| RU | 2203380 | C1 | 4/2003 |
| WO | 9927254 | A1 | 6/1999 |
| WO | 2006123927 | A1 | 11/2006 |
| WO | 2008091262 | A1 | 7/2008 |
| WO | 2009127831 | A2 | 10/2009 |
| WO | 2012068522 | A2 | 5/2012 |
| WO | 2013177378 | A1 | 11/2013 |

OTHER PUBLICATIONS

Transmittal of the International Search Report and the Written Opinion of the International Searching Authority, mailed Jul. 18, 2012 in International Application No. PCT/US2011/061499 (14 pages).

Office Action in a related U.S. Appl. No. 13/480,080 issued on Jul. 15, 2014 (23 pages).

Notification of the First Office Action and Search Report for Chinese Application No. 01180063921.7 dated Jul. 2, 2014.

Russian Official Action for Russian Application No. 2013127648 dated Oct. 3, 2014.

Extended European Search Report for EP Application No. 11841152.9 dated Feb. 6, 2015.

Notification of the First Office Action and Search Report for Chinese Application No. 201380033334.2 dated Sep. 18, 2015.

Official Action issued in corresponding Russian Application No. 2014152272/03 with English translation dated Jan. 27, 2016 (13 pages).

Extended European Search Report issued in corresponding European Application No. 13793462.6 dated Feb. 10, 2016 (8 pages).

Decision on Grant issued in related RU application 2013127648 on Feb. 10, 2016, 14 pages.

* cited by examiner

APPARATUS AND METHOD FOR CONTROLLING OR LIMITING ROTOR ORBIT IN MOVING CAVITY MOTORS AND PUMPS

CROSS-REFERENCE TO RELATED APPLICATIONS

This application claims priority to UK Patent Application No. 1019614.5 filed on Nov. 19, 2010, which is herein incorporated by reference in its entirety. It is also related to PCT/US11/61499, filed Nov. 18, 2011, which is herein incorporated by reference in its entirety.

FIELD OF THE DISCLOSURE

Embodiments disclosed herein relate to apparatus and methods for controlling or limiting the position of a rotor relative to a stator in a moving cavity motor or pump. In another aspect, embodiments disclosed herein relate to apparatus and methods for controlling or limiting the position of a rotor relative to a stator in a mud motor.

BACKGROUND

Moving cavity motors or pumps, sometimes known as positive displacement motors or pumps, or progressive or progressing cavity motors or pumps, work by trapping fluid in cavities. The cavities are formed in spaces between the rotor and the stator, and the relative rotation between these components is the mechanism which causes the cavities to progress and travel axially along the length of the device from the input end to the output end. If the rotor is forced to rotate, fluid is drawn along in the cavities and the device will be a pump. If the fluid is pumped into the input end cavity at a higher pressure than that at the outlet end, the forces generated on the rotor cause it to rotate and the device will be a motor.

In order that the rotor can rotate within the stator and generate cavities that will progress in an axial direction, the profiles of both components must take specific forms. Typically, the rotor (2) will be a helically shaped shaft with a sectional shape similar to those shown in FIG. 1. The number of lobes on the rotor (2) can vary from one to any number. The stator (4) has a profile which complements the shape of the rotor (2), with the number of lobes varying between two and any number, examples of which are illustrated in FIG. 2. In a matching rotor-stator pair, the number of lobes on the stator (4) will be one greater than on the rotor (2). A section through a typical combination of rotor (2) and stator (4) is shown in FIG. 3, in which the rotor (2) has three lobes and the stator (4) has four lobes, with the rotor (2) being received within the stator (4).

One of the surfaces, often that of the stator (4), is flexible so that seals (6) can be maintained between the points of contact of the rotor (2) and the stator (4). The seals (6) define a plurality of cavities (8) between the rotor (2) and the stator (4) and still allow for relative rotation between the rotor (2) and stator (4). The rotor (2) and stator (4) sections typically remain the same along the length of the motor or pump (10), but progressively rotate to result in a helical profile. A section through a diametral plane of part of a motor or pump (10) is shown in FIG. 4.

The rotor (2) does not have to be of a fixed length. The chosen length is often defined in stages where one stage consists of a complete rotation of the helix of the stator (4). The cavities (8) are formed between the stator (4) and the rotor (2).

It will be apparent from the sections in FIG. 3 and FIG. 4 that the geometric centre of the rotor (2) does not remain fixed relative to the stator (4) as the rotor (2) turns. Generally, where the rotor (2) has two or more lobes, the trajectory of the centre point is roughly a circle, with variations caused by the exact nature of the surface profiles and any deformations in the flexible materials used to maintain the inter-cavity seals (6). Both in the case of a motor, where the rotor (2) provides the driving torque, and for a pump where the rotor (2) is driven, a drive shaft assembly (12) is required to transform a rotation about an orbiting axis to a rotation about a fixed axis. This drive shaft assembly (12) has a moveable joint assembly (14) to facilitate this mechanism. In the case of a motor, the outside end of the drive shaft (13) is connected to the component that requires to be driven, a drill bit for example in the case of a downhole motor. For a pump, the outside end of the drive shaft (13) is connected to a source of rotational energy such as a motor.

The torque that is generated in the rotor (2) in the case of the device being a motor, or required in the rotor (2) in the case of the device being a pump, is a complex combination of the pressure forces acting in the cavities (8) and the reaction forces between the points of contact between the stator (4) and the rotor (2). This has the effect of trying to turn the rotor (2) in the case of a motor or resisting rotation in the case of a pump. In both cases there is also a net lateral force that acts to push the rotor (2) into the stator (4). The direction of this force rotates as the rotor (2) turns. There is also a centrifugal force generated by the orbital motion of the rotor. And in the case of a motor, such as a mud motor, there may be a lateral component of the thrust carried by the transmission.

SUMMARY OF THE CLAIMED EMBODIMENTS

It has been found that a consequence of the forces acting on a rotor and the pushing of the rotor into the stator is that the flexible surface of the stator can deform and allow a gap to form on one side of the device. If this happens, then fluid can pass along the device between the fluid cavities. The effect of this is to reduce the flow rate and maximum pressure for a pump and to reduce the rotary speed and limit the developed torque in the case of a motor.

Embodiments disclosed herein may be used to overcome some of the limitations of known mud pumps and other moving cavity motors or pumps, or at least to provide an alternative to known mud pumps and other moving cavity motors or pumps.

According to a first aspect of embodiments disclosed herein, there is provided a moving cavity motor or pump comprising: a rotor, a stator and apparatus for controlling or limiting the movement of the rotor relative to the stator.

As discussed, a surface of the rotor or the stator may be made of a flexible material to permit a seal to form between contacting surfaces of the rotor and the stator, and in one or more embodiments the movement of the rotor relative to the stator is controlled or limited to minimise deformation of the flexible material and the consequential opening of gaps between the contacting surfaces of the rotor and the stator.

In one or more embodiments, the rotor is constrained to follow a desired rotational and positional movement.

In one or more embodiments, the rotor is constrained by a precession device constructed such that rotor rotation can be made dependent on rotor position.

In one or more embodiments, the precession device consists of a lobed wheel, connected to the rotor shaft that follows a lobed track connected to the stator.

In one or more embodiments, the ratio of the number of lobes on the wheel to the number of lobes on the track is the same as the ratio of the number of lobes on the rotor to the number of lobes on the stator.

In one or more embodiments, the lobed wheel has a compliant layer on the outside surface that mates with the track. Alternatively or additionally, the lobed track has a compliant layer on the surface that mates with the lobed wheel.

In one or more embodiments, the radial movement of the rotor relative to the stator is controlled or limited.

In one or more embodiments, the movement of a geometric centre of the rotor is limited to a predetermined path in use of the motor or pump.

In one or more embodiments, there is provided a wheel assembly at one or more locations to control or limit the movement of the rotor within, or around, the stator.

In one or more embodiments, the wheel assembly comprises a wheel mounted on a shaft of the rotor, the wheel being configured to run around an inner surface of the stator.

In one or more embodiments, the outside diameter of the wheel is equal to the diameter of the inner surface of the stator minus twice the predetermined maximum offset of the rotor from its geometric centreline.

Alternatively, the wheel assembly may comprise a wheel mounted on a shaft of the stator, the wheel being configured to permit the rotor to run around an outer surface of the stator. One skilled in the art would readily understand that in such an embodiment the inner component is fixed (thus being the stator or stationary member) while the outer component of the motor or pump rotates (the rotor or rotating member).

In one or more embodiments, the outside diameter of the wheel is equal to that of the inner surface of the rotor minus twice the predetermined maximum offset of the rotor from its geometric centreline.

In one or more embodiments, the wheel assembly is located at a position in the motor or pump where the profile of the rotor and the stator are substantially circular.

In one or more embodiments, the wheel assembly further comprises a bearing to permit relative rotation between the wheel and the rotor. The bearing may conveniently be a needle bearing.

In one or more embodiments, the wheel has apertures to permit the flow of fluid therethrough.

In one or more embodiments, engaging surfaces of the rotor and the stator are substantially rigid in the area of the wheel assembly.

In one or more embodiments, there is provided a fixed insert at one or more locations to control or limit the movement of the rotor within, or around, the stator.

In one or more embodiments, the fixed insert is mounted within an outer member of the rotor-stator pair and has a central aperture through which a shaft of an inner member of the rotor-stator pair can pass, the diameter of the central aperture being sized to limit the radial motion of the rotor relative to the stator.

In one or more embodiments, the fixed insert has a further plurality of apertures to permit the flow of fluid therethrough.

In one or more embodiments, the fixed insert is located at a position in the motor or pump where the profiles of the rotor and/or stator are substantially circular.

In one or more embodiments, the central aperture is substantially circular such that the shaft of the rotor can run around the central aperture, or the rotor and fixed insert can run around the stator.

In one or more embodiments, there is provided a drive shaft assembly at one or more locations to control or limit the movement of the rotor within, or around, the stator.

In one or more embodiments, the drive shaft assembly comprises: a driver shaft and a driven shaft, such that rotation may be transmitted when the two shafts are not parallel; and a mechanism for limiting the angle between the driver shaft and the driven shaft such that the movement of the rotor relative to the stator is limited.

In one or more embodiments, the mechanism for limiting the angle of the driver shaft and the driven shaft is a buffer ring.

In one or more embodiments, there is provided a rotatable insert at one or more locations to control or limit the movement of the rotor within the stator.

In one or more embodiments, the rotatable insert is mounted within the stator and has an aperture through which a shaft of the rotor can pass, the aperture being offset from the centre of the rotatable insert such that movement of the rotor is limited to a predetermined path.

In one or more embodiments, the rotatable insert is free to rotate within the stator.

In one or more embodiments, the rotor is free to rotate within the rotatable insert.

In one or more embodiments, a bearing is provided to facilitate rotation of the rotatable insert and/or rotor.

In one or more embodiments, the rotatable insert comprises a further plurality of apertures to permit the flow of fluid therethrough.

In one or more embodiments, there is provided a piston assembly at one or more locations to control or limit the movement of the rotor within, or around, the stator.

In one or more embodiments, the piston assembly comprises a plurality of inward facing pistons spaced around the outer member of the rotor-stator pair to control the movement of the rotor relative to the stator. The pistons may conveniently be evenly spaced around the outer member of the rotor-stator pair.

In one or more embodiments, the pistons are mounted into an insert which is itself mounted onto the outer member of the rotor-stator pair.

In one or more embodiments, the outer member of the rotor-stator pair is locally thickened in the regions where the pistons are mounted.

In one or more embodiments, the insert is provided with a plurality of apertures to permit the flow of fluid therethrough.

According to a second aspect of embodiments disclosed herein, there is provided a method for improving the performance of a moving cavity motor or pump, comprising the step of controlling or limiting the movement of the rotor relative to the stator to minimise the opening of gaps between the rotor and stator.

In one or more embodiments, the control or limitation of the movement of the rotor relative to the stator is in addition to any restrictions caused by contact with the stator or by connections made to the end of the rotor.

In one or more embodiments, the radial movement of the rotor is controlled or limited relative to the stator.

In one or more embodiments, the rotor is controlled to follow a predetermined combination of path and rotation using a precession device.

In one or more embodiments, the movement of a geometric centre of the rotor is limited to a predetermined path.

In one or more embodiments, a wheel is provided between the rotor and the stator to limit the movement therebetween.

In one or more embodiments, a fixed insert is provided between the rotor and the stator to limit the movement therebetween.

In one or more embodiments, a drive shaft is connect to the rotor to limit the relative movement between the rotor and the stator.

In one or more embodiments, a rotatable insert is provided between the rotor and the stator, the insert having an aperture offset from its centre through which a shaft of the rotor extends, to limit the relative movement between the rotor and the stator.

In one or more embodiments, a piston arrangement is provided between the rotor and the stator to limit the movement therebetween.

In another aspect, embodiments disclosed herein are related to a method of drilling a wellbore through a subterranean formation. The method may include: passing a drilling fluid through a mud motor assembly, the mud motor assembly comprising a moving or progressive cavity motor having a proximal end and a distal end, the motor comprising: a stator and a rotor, wherein a surface of the stator is made of a flexible material to permit a seal to form between contacting surfaces of the rotor and the stator; at least one apparatus disposed proximate at least one of the proximal end and the distal end, the at least one apparatus constraining the radial and/or tangential movement of the rotor relative to the stator; and drilling the formation using a drill bit directly or indirectly coupled to the rotor.

In another aspect, embodiments disclosed herein relate to a mud motor assembly comprising a moving or progressive cavity motor having an inlet end and an outlet end. The motor may include: a stator and a rotor, wherein a surface of the stator is made of a flexible material to permit a seal to form between contacting surfaces of the rotor and the stator; at least one apparatus disposed proximate at least one of the inlet end and the outlet end, the at least one apparatus constraining the radial and/or tangential movement of the rotor relative to the stator.

In another aspect, embodiments disclosed herein relate to a drilling assembly. The drilling assembly may include: a mud motor assembly comprising a moving or progressive cavity motor having a proximal end and a distal end, including: a stator and a rotor, wherein a surface of the stator is made of a flexible material to permit a seal to form between contacting surfaces of the rotor and the stator; at least one apparatus disposed proximate at least one of the proximal end and the distal end, the at least one apparatus constraining the radial and/or tangential movement of the rotor relative to the stator; and a motor output shaft directly or indirectly coupled to the distal end of the rotor; and a drill bit directly or indirectly couple to a distal end of the motor output shaft.

In another aspect, embodiments disclosed herein relate to a moving or progressive cavity motor or pump assembly having an inlet end and an outlet end. The motor or pump may include: an inner member disposed within an outer member, one comprising a stator and the other a rotor, wherein a surface of the rotor or the stator is made of a flexible material to permit a seal to form between contacting surfaces of the rotor and the stator; at least one apparatus disposed proximate at least one of the inlet end and the outlet end, the at least one apparatus constraining the radial and/or tangential movement of the rotor relative to the stator.

In another aspect, embodiments disclosed herein relate to a method of manufacturing a moving or progressive cavity motor or pump having an inlet end and an outlet end, the method comprising: disposing an inner member within an outer member, one comprising a stator and the other a rotor; the inner member having a section having a profiled helical outer surface; the outer member comprising a first section having a profiled helical inner surface and at least one second section having a circular inner surface, the at least one second section being proximate at least one of the inlet end and the outlet end and concentric with the first section; operatively connecting at least one apparatus for constraining the radial and/or tangential movement of the rotor relative to the stator to at least one of the inner member and the outer member along a length of the respective at least one second section.

In another aspect, embodiments disclosed herein relate to a method of manufacturing an outer member of a moving or progressive cavity motor or pump, such as a stator for a mud motor, the method comprising: aligning a tubular outer member with a moulding, machining, and/or spray coating device, wherein the centreline of the tubular outer member and the centreline of the device may be the same or different; moulding, machining, and/or spray coating a first inner portion of the outer member to have a profiled helical inner surface and at least one second inner portion having an inner surface of approximately constant inner diameter and concentric with the first inner portion, the second inner portion being configured to house an apparatus for constraining the radial and/or tangential movement of an inner member disposed therein.

BRIEF DESCRIPTION OF DRAWINGS

The motors and pumps disclosed herein will now be described, purely by way of example, with reference to the accompanying drawings, in which.

DETAILED DESCRIPTION

Embodiments of the motors or pumps disclosed herein constrain the rotor to maintain a prescribed motion, in other words, they limit the path for the geometric centre of the rotor, and in some cases, lock the rotation to that path. Although various embodiments are illustrated, it will be appreciated that other systems for controlling or limiting the radial and/or tangential movement of the rotor relative to the stator could also be conceived within the scope of the present disclosure. Movement of a rotor relative to a stator is generally limited only by the inherent resilience of the materials used to form the rotor and stator (e.g., deflection/compression of the rubber lining of the stator, etc.). As used herein, constraining the movement of the rotor relative to the stator refers to restricting or limiting the movement to a greater extent than would otherwise result or be permitted by the inherent resilience of the materials used to form the rotor and stator during use.

It should be understood that although the illustrated embodiments have the rotor as a component that revolves within the stator, and indeed most pumps and motors are arranged this way, the embodiments will work equally as well if the inside component is fixed and the outside component rotates.

Figure 1:
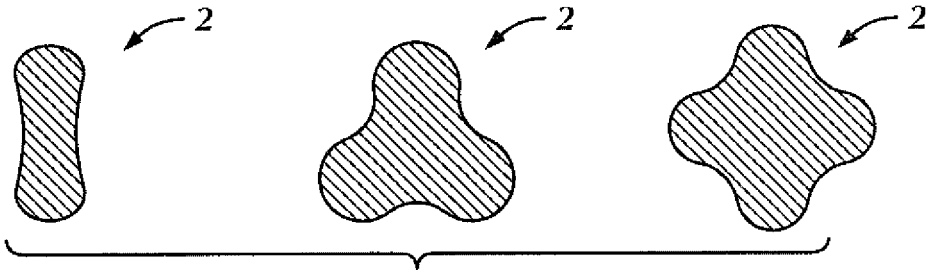
FIG. 1 shows a sectional view of a selection of known rotors
Figure 2:
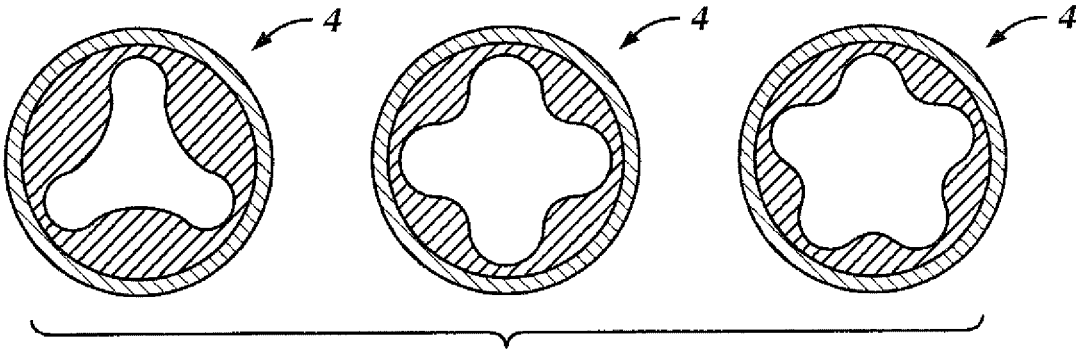
FIG. 2 shows a sectional view of a selection of known stators.
Figure 3:
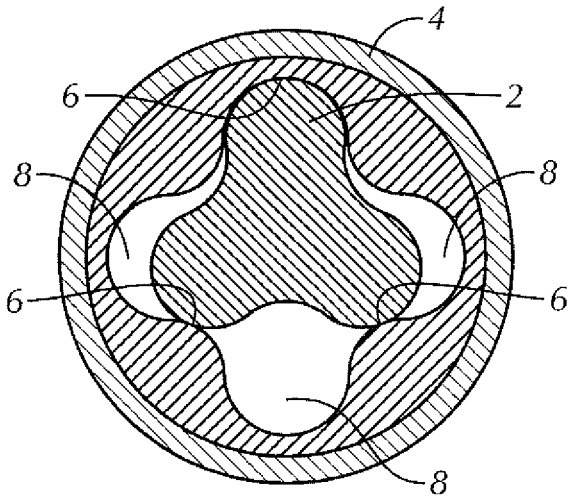
FIG. 3 shows a sectional view of a known moving cavity motor or pump.
Figure 4:
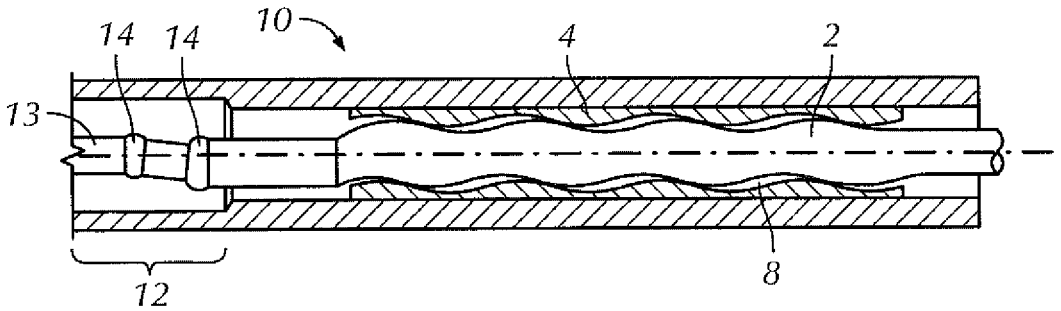
FIG. 4 shows a diametral sectional view of a known moving cavity motor or pump.
Figure 5:
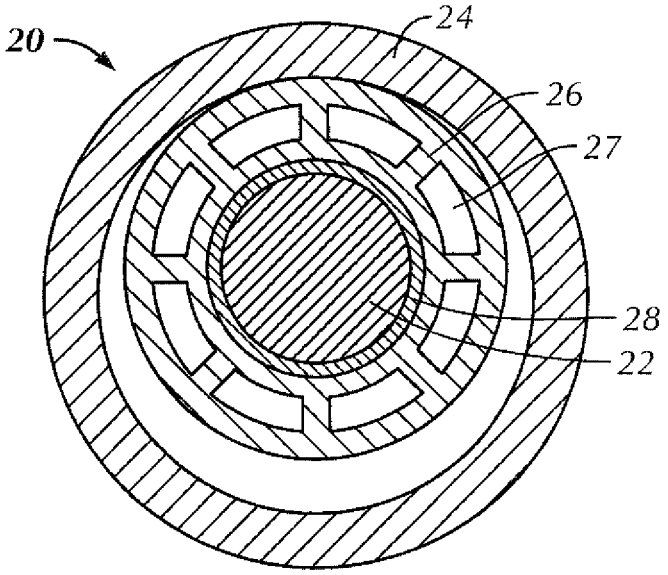
FIG. 5 shows a sectional view of a first embodiment of a motor or pump having an apparatus for controlling or limiting the radial movement of a rotor relative to a stator.
Figure 6:
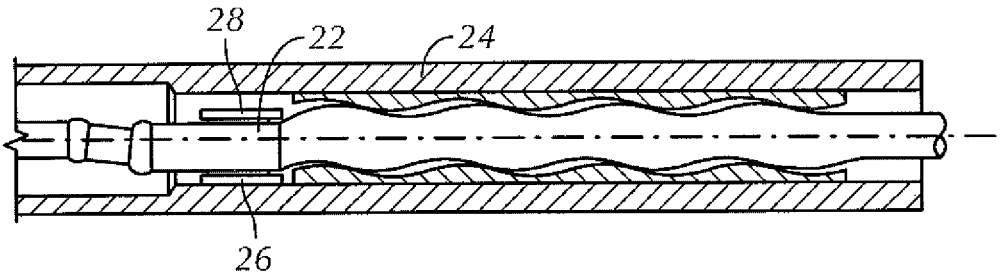
FIG. 6 shows a longitudinal sectional view through a moving cavity motor or pump fitted with the apparatus of FIG. 5.

Referring firstly to FIGS. 5 and 6, these show a first embodiment of an apparatus (20) for controlling or limiting the radial movement of a rotor (22) relative to a stator (24). The apparatus comprises a wheel assembly (20) to be used at one or more locations on the rotor (22). A section through the wheel assembly (20) is shown in FIG. 5.

A bearing wheel (26) is supported onto the rotor shaft (22) through a needle bearing (28), although another suitable bearing could also be used, such as roller bearings or journal bearings. In some embodiments, the bearings (28) are journal bearings comprising silicon carbide, tungsten carbide, silicon nitride or other similarly wear resistant materials. The bearing wheel may be manufactured with steel or other materials suitable for the intended environment. The outside surface of the bearing wheel (26) is designed to slide or roll around the inside surface of the stator body (24) at a position where the profile is approximately circular. The difference in the radius of the bearing wheel (26) and the inside surface of the stator body (24) defines the maximum offset of the rotor axis from the stator axis. The bearing wheel (26) has passages (27) incorporated to increase the area for fluid to flow along the device, where the passages may be of any number or shape, with the proviso that they be large enough to pass any solids that may be in the power fluid or pumped fluid. The stator body (24) has a circular profile where the bearing wheel (26) makes contact, such that the rotor shaft (22) centreline will be constrained to remain approximately within a circle of fixed radius and this helps to prevent the opening of gaps between the rotor (22) and stator (24) surfaces. FIG. 6 shows a longitudinal section through a motor or pump that has been fitted with a wheel assembly (20) according to FIG. 5, at one end only, although additional wheel assemblies may be located at additional locations.

Figure 11A:
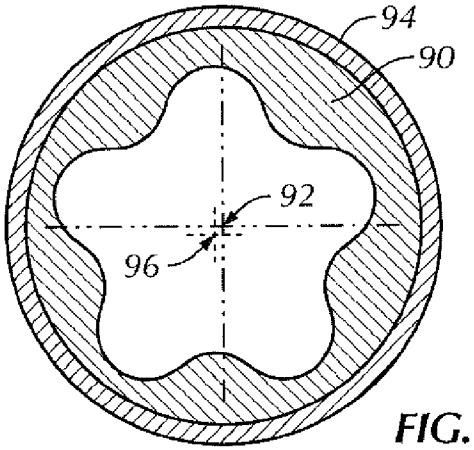
FIG. 11A-11C illustrate cross-sectional and longitudinal section views of a liner configured to maintain concentricity of apparatus for constraining the movement of a rotor relative to a stator according to embodiments disclosed herein.
Figure 11B:
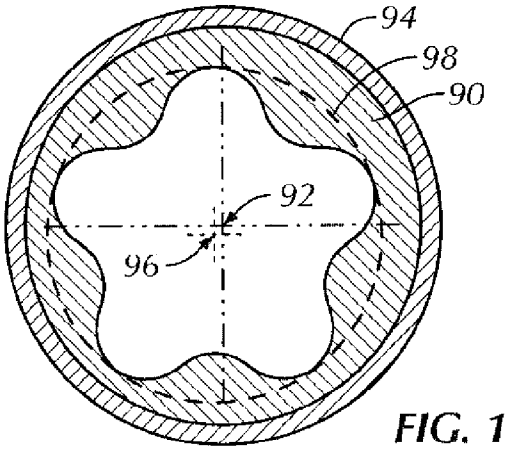
Figure 11C:
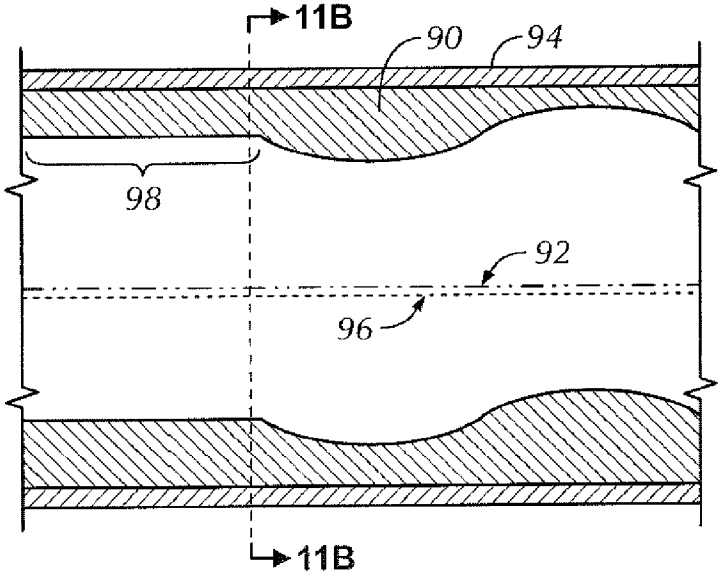

In some embodiments, the bearing wheel (26) may slide or roll in contact with the interior surface of the stator cylinder itself. In other embodiments, the bearing wheel (26) may slide or roll in contact with a coating placed on the interior surface of the stator cylinder. During manufacture of some stators, the interior surface of a cylinder, such as a pipe or tube, is lined, such as by pouring or injecting a liner material onto the interior surface of the cylinder. However, due to the complexity of the stator manufacturing process, concentricity of the resulting stator with the stator cylinder itself cannot be guaranteed. Thus, during manufacture, the resulting stator liner (90) may be offset from the centreline (92) of the stator cylinder (94), such as illustrated in FIG. 11A where the resulting liner has a centreline (96) offset from the centreline (92) of the stator cylinder (94). As noted above, the outside surface of the bearing wheel (26) is designed to slide or roll around the inside surface of the stator body (24) where the profile is approximately circular. The bearing wheel (26) should thus also slide or roll around the inside surface of the coating material, such that the bearing wheel (26) slides or rolls along the same centreline as the stator liner (i.e., aligned with stator liner and rotor, not with the stator cylinder). Manufacture of a stator for use with the bearing wheel (26) may thus include coating, moulding or machining a section (98) of constant diameter (such as 1.6 mm (1/16 inch) to 12.8 mm (½ inch) thick rubber) at one or both ends of the stator, as illustrated in FIGS. 11B and 11C, so as to ensure that the bearing wheel (26) properly constrains the path of the rotor and provide the desired benefit.

As noted above, the difference in the radius of the bearing wheel (26) and the inside surface of the stator body (24) defines the maximum offset of the rotor axis from the stator axis. Additionally, for proper function, the bearing wheel (26) must maintain a sliding and/or rolling relationship with the inner surface of the stator so as to constrain the rotor through the entire rotation, i.e., maintaining contact over 360°. Due to the eccentric rotation of the rotor, the relative diameter of the bearing wheel (26) to that of the interior surface of the stator (90) is an important variable, where an improper ratio may result in irregular contact of the bearing wheel with the inner surface of the stator, i.e., a non-rolling or non-sliding relationship.

In addition to diameter, the length of the bearing wheel (26) must also be sufficient to maintain the side loads imparted due to the wobble of the rotor. Bearing wheel (26) should be of sufficient axial dimensions to address the structural considerations. The length of bearing wheel (26) may thus depend upon the number of lobes, motor/pump torque, and other variables readily recognizable to one skilled in the art, and may also be limited by the available space between the rotor and the drive shaft.

The bearing wheel (26) limits the extent of the wobble imparted by the eccentric motion of the rotor. This, in turn, may limit the formation of flow gaps along the length of the motor/pump by limiting the compression or deflection in the stator lining, such as a rubber or other elastic material. In some embodiments, the bearing wheel may limit the deflection of the stator lining by less than 0.64 mm (0.025 inches); by less than 0.5 mm (0.02 inches) in other embodiments; and by less than 0.38 mm (0.015 inches) in yet other embodiments. Similar deflection limits may also be attained using other embodiments disclosed herein.

Bearing wheel (26), as described above, radially constrains the position of the rotor, keeping the rotor in contact with the stator (i.e., providing an offset contact force without preventing the generation of torque). The resulting reduced normal force at the point of contact between the rotor and stator may reduce the drag forces, improving compression at the contact points, minimizing leakage paths. By limiting the formation of flow gaps (leakage paths) along the length of the rotor, pressure losses may be decreased, increasing the power output of the motor. Additionally, constraining the position of the rotor may reduce stator wear, especially proximate the top of the lobes, where tangential velocities are the highest.

Figure 7:
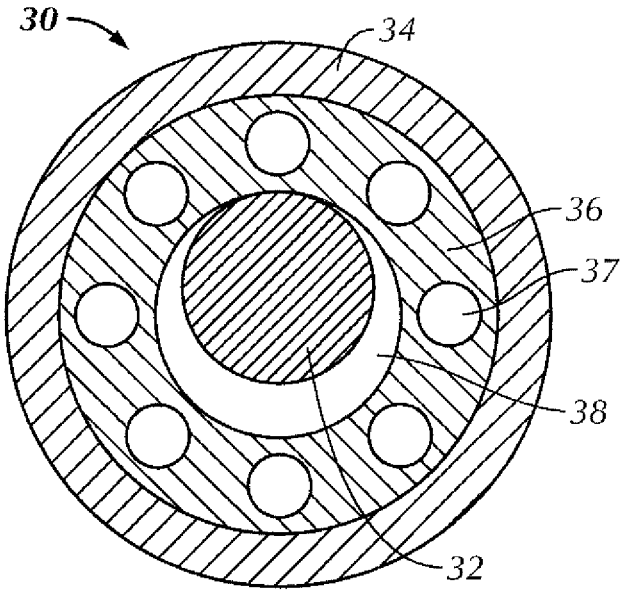
FIG. 7 shows a sectional view of a second embodiment of a motor or pump having an apparatus for controlling or limiting the radial movement of a rotor relative to a stator.

Referring now to FIG. 7, this shows a second embodiment of an apparatus (30) for controlling or limiting the movement of a rotor (32) relative to a stator (34), in which a fixed insert (36) is fitted inside the stator (34). The fixed insert (36) may be provided at one or more locations within the stator (34). The fixed insert (36) has a central hole (38) or similar restriction of the stator (34) inside diameter to limit the radial movement of the rotor (32) relative to the stator (34). The fixed insert (36) may also comprise a plurality of holes (37) to facilitate the passage of fluid along the motor or pump. The fixed insert (36) ensures that the rotor shaft (32) centreline will be constrained to remain approximately within a circle of fixed radius and this helps to prevent the opening of gaps between the rotor (32) and stator (34) surfaces.

Similar to the embodiments of FIGS. 5, 6, and 11, the fixed insert (36) as shown in FIG. 7 may be disposed within a moulded stator profile such that the fixed insert (36) has the same centreline as the stator liner (32). In some embodiments, the fixed insert (36) may be a raised section of the moulded stator profile. In some embodiments, the ratio of the diameter of the fixed insert (36) to the diameter of the rotor (32) may be such that a true or pure rolling diameter is achieved. Bearings may also be used to allow for slip between fixed insert (36) and rotor (32) where a true rolling diameter ratio is not used. Similar issues with respect to flow paths, torque requirements, and axial length of the insert should also be addressed when constraining the rotor according to the embodiment of FIG. 7. With respect to torque requirements, it may be desirable in some embodiments to have an enlarged rotor cross section proximate fixed insert (36), rather than necking down the rotor cross section so as to provide a sliding or rolling relationship.

Figure 8:
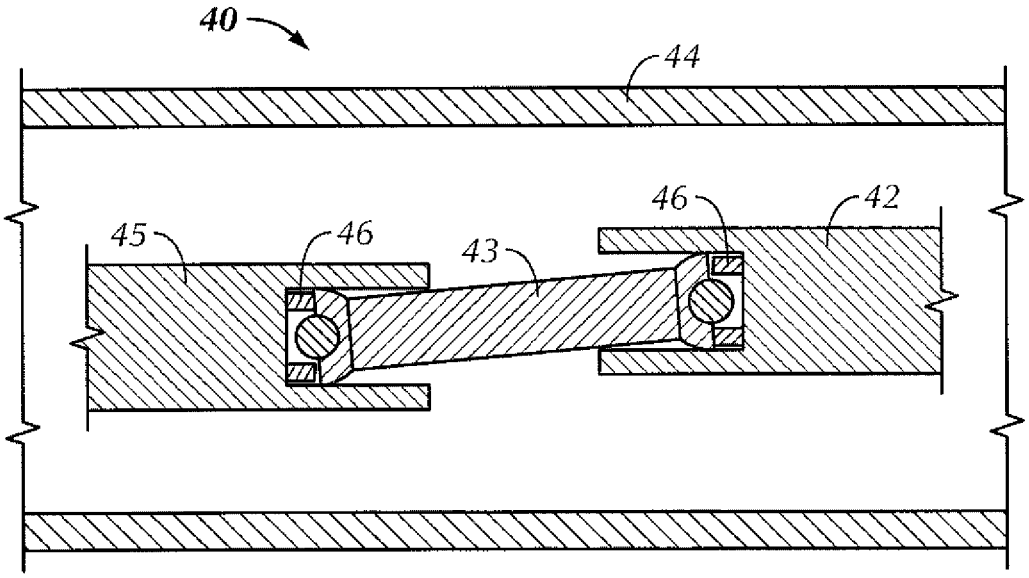
FIG. 8 shows a sectional view of a third embodiment of a motor or pump having an apparatus for controlling or limiting the radial movement of a rotor relative to a stator.

A third embodiment of an apparatus (40) for controlling or limiting the movement of a rotor (42) relative to a stator (44) is illustrated in FIG. 8. A modified drive shaft (43) is provided at one end of the rotor (42) to restrict the radial motion of the rotor (42). There could also be a similar articulated shaft at the other end to restrict the radial motion of the rotor (42) at that end. The articulation angle at one end of the driveshaft (43) can be limited by, for example, a buffer ring (46) attached to the output shaft in the case of a motor (45) or the input shaft in the case of a pump (45), such that when contact is made, there is a limit imposed on the radial motion of the rotor. An equivalent embodiment could have the buffer ring (46) attached to the rotor (42) and this would similarly restrict the radial motion of the rotor (42). The driveshaft (43) ensures that the rotor shaft centreline will be constrained to remain approximately within a circle of fixed radius and this helps to prevent the opening of gaps between the rotor and stator surfaces.

Figure 9:
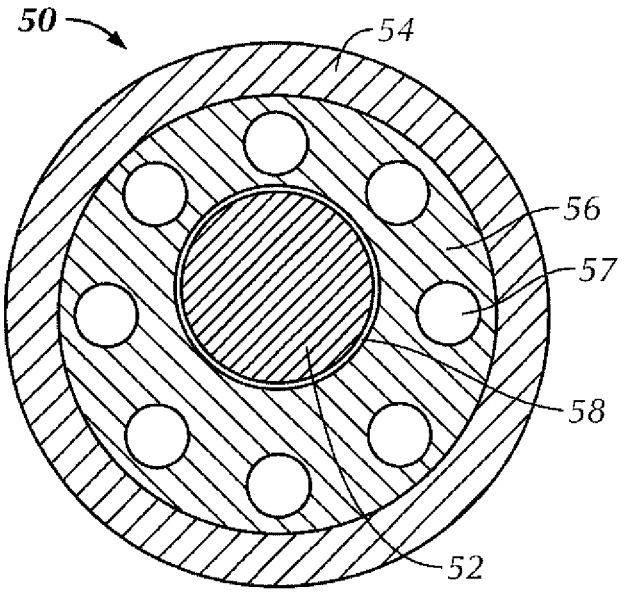
FIG. 9 shows a sectional view of a fourth embodiment of a motor or pump having an apparatus for controlling or limiting the radial movement of a rotor relative to a stator.

A fourth embodiment of an apparatus (50) for controlling or limiting the movement of a rotor (52) relative to a stator (54) is shown in FIG. 9. The apparatus (50) consists of a rotatable circular insert (56) which is fitted inside the stator body (54) and able to rotate about the longitudinal axis relative to the stator (54). The rotatable insert (56) may be provided at one or more locations within the stator (54). The rotation of the insert (56) relative to the stator (54) is facilitated by a bearing between the stator and the insert (not shown). An aperture (58) is provided in the insert (56), with the centre of the aperture (58) offset from the centre of the insert (56) by a distance equal to the maximum permissible offset of the rotor axis from the stator axis. The diameter of the aperture (58) is of sufficient size to allow the rotor (52) to pass through and rotate freely. A further bearing (not shown) is provided between the insert (56) and the rotor (52) to facilitate the rotation of the rotor (52) relative to the insert (56). The circular insert (56) is penetrated by holes (57) to allow the passage of fluid along the motor or pump. The insert (56) ensures that the rotor shaft (52) centreline will be constrained to remain approximately within a circle of fixed radius and this helps to prevent the opening of gaps between the rotor (52) and stator (54) surfaces.

Figure 10:
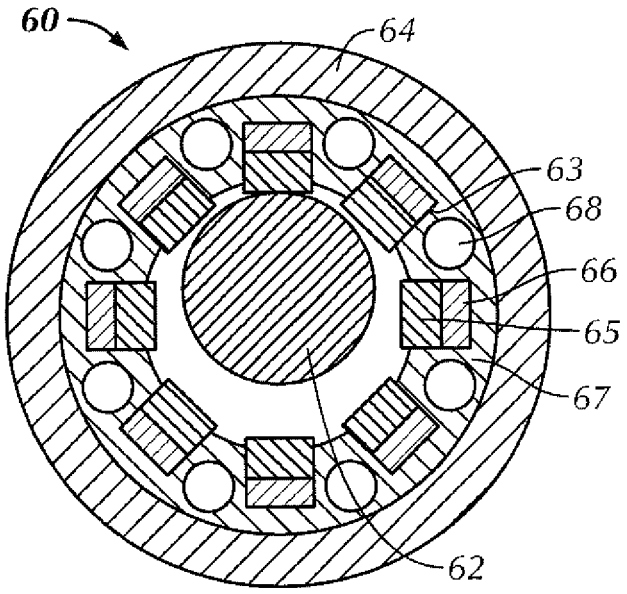
FIG. 10 shows a sectional view of a fifth embodiment of a motor or pump having an apparatus for controlling or limiting the radial movement of a rotor relative to a stator.

A fifth embodiment of an apparatus (60) for controlling or limiting the movement of a rotor (62) relative to a stator (64) is illustrated in FIG. 10. A plurality of pistons (65), reacted by constrained material (66) which could be solid, liquid or gaseous, are used to limit the radial motion of the rotor (62). The piston assembly (65) may be provided at one or more locations within the stator (64). FIG. 10 shows an example where eight such pistons (65) are used, although a different number of pistons could also be used. The cylinder housings (63) to contain the pistons (65) are machined into a circular insert (67) which is fitted inside the stator body (64) and is of sufficient thickness to prevent the loads imposed from causing structural failure. The circular insert (67) is provided with a plurality of holes (68) to allow fluid to pass along the motor or pump. When the rotor (62) makes contact with a piston (65), the constrained material (66) is compressed and prevents free motion of the piston (65), thus limiting the motion of the rotor (62). The apparatus (60) ensures that the rotor shaft (62) centreline will be constrained to remain approximately within a circle of fixed radius and this helps to prevent the opening of gaps between the rotor (62) and stator (64) surfaces.

As described above, the embodiments illustrated in and described with respect to FIGS. 5-11 provide for limiting or constraining the extent of the radial movement of the rotor (i.e., limiting the orbital trajectory and path of the rotor during rotation). The embodiments disclosed herein may effectively limit outward radial movement, such as the restraint illustrated in FIG. 5, and may also limit the inward radial movement of the rotor, such as the restraint illustrated in FIG. 9.

Figure 12A:
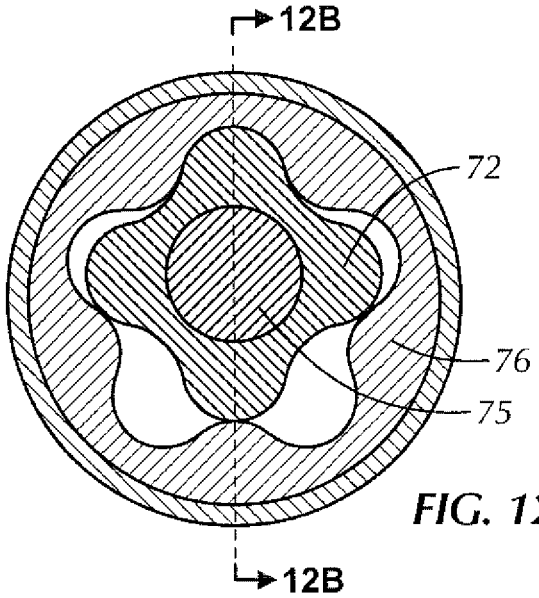
FIG. 12A shows a sectional view of a first embodiment of a motor or pump having an apparatus for controlling the path and rotation of the rotor relative to the stator.

In addition to the relatively circular means for constraining radial movement as illustrated in FIGS. 5-11, it is also possible to constrain movement of the rotor using a non-circular restraint, such as illustrated in FIGS. 12A (profile view) and 12B (longitudinal section view). In this embodiment, a precession apparatus (70) comprising a lobed wheel (72) of similar, but not identical profile to that of rotor (74) is operably connected to rotor shaft (75). Similarly, lobed wheel (72) would engage a track (76) of similar, but not identical, profile to that of stator (78). Track (76) may be formed of a material similar to that of stator (78), or may be a material that is less compressible than stator (78), such as a harder rubber or steel. A precession apparatus (70) may be used at one or more locations along rotor (74).

Precession apparatus (70) controls the rotor (74) such that it will move on a prescribed path and with a prescribed rotation relative to stator (78). This type of restraint may effectively lock the rotation of the rotor to its orbit position. The lobed wheel (72) engages with lobed track (76) such that the relative profiles of the lobed wheel (72) and track (76) fix the path and rotation of the rotor (74) to prescribed values.

The lobed wheel (72) is connected to the rotor shaft (75) in a substantially fixed way. The ratio of the number of lobes on the wheel (72) to the number of lobes on the track (76) is limited to the same ratio as the number of lobes on the rotor (74) to the number of lobes on the stator (78). The profiles of the lobes on the wheel (72) and on the track (76) will determine the extent to which the rotor (74) can deform the sealing surface of the stator (78) and therefore limits the opening of gaps between them.

To allow some rotational compliance, the surface of the lobed wheel (72) or the track (76) may have a flexible layer added of, for example, rubber. The lobed wheel (72) and track (76) could have parallel sides or incorporate a helix angle to allow for some small axial movement and accommodate manufacturing tolerances.

The profile and composition (material of construction, compressibility, etc.) of lobed wheel (72) may be designed such that the deformation of the rubber in stator (78) is limited. In other embodiments, the profile and composition of lobed wheel (72) may be designed such that the deformation of the rubber in stator (78) is maintained to a fixed value. In this manner, the interaction between the rotor (74) and the rubber in stator (78) is used to maintain sealing, with the torque being generated largely on lobed wheel (72). This not only allows pressure loading up to the point where the seal would fail (a very high pressure) but it also ensures that the contact forces in the rubber can be kept substantially independent of pressure magnitude. This should reduce wear and fatigue failure in the rubber as well as improve motor/pump efficiency.

Figure 13:
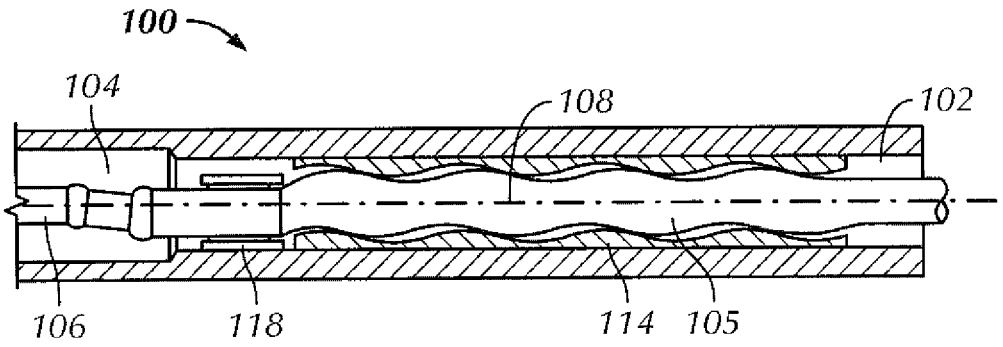
FIGS. 13-15 illustrate various mud motor assemblies/drilling assemblies having one or more apparatus for controlling the path and rotation of the rotor relative to the stator.

Motors according to embodiments disclosed herein may be used, for example, as a mud motor in a drilling assembly. Referring to FIG. 13, in operation a drilling fluid is pumped into the inlet end (102) of a mud motor (100) at a higher pressure than that at the outlet end (104), generating forces on the rotor (105) and causing the rotor (105) to rotate. Rotor (105) is operably connected to a drive shaft (106) for converting the orbital rotation of the rotor (105) to a rotation about a fixed axis (108). The distal end of the drive shaft (not shown) is directly or indirectly coupled to a drill bit (not shown), rotation of which may be used to drill through an underground formation.

Forces imposed on the rotor (105) during operation include those due to the pressure differential across the motor (100) from inlet (proximal) end (102) to outlet (distal) end (104). The pressure differential may result in a pitching moment. There is also a downward force exerted on the drill string, commonly referred to as "weight on bit," where this force is necessarily transmitted through the rotor—drive shaft—drill bit couplings. The orbital-axial relationship of the drive shaft coupling may result in angular and/or radial forces being applied to rotor (105). Rotation of rotor (105) also results in tangential forces.

Each of these forces may have an impact on the manner in which rotor (105) interacts with stator (114) (e.g., compressive forces generating seals along the edges of the resulting cavities, sliding, drag, or frictional forces between rotor (105) and stator (114) as the rotor rotates, etc.), and may cause a gap to form along the length of the motor (100), reducing motor efficiency. Additionally, the impact of these forces may be different proximate inlet end (102) and outlet end (104). The various apparatus disclosed herein for constraining the rotor as discussed above may be used to control or limit the movement of rotor (105) proximate inlet end 102, outlet end 104, or both.

Figure 14:
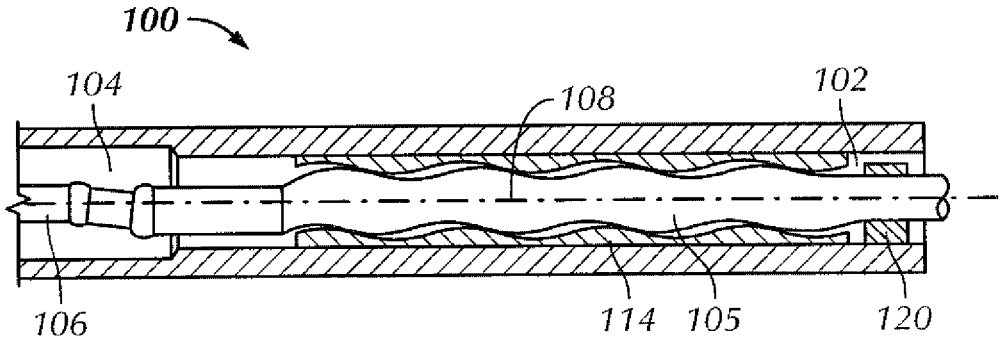
Figure 15:
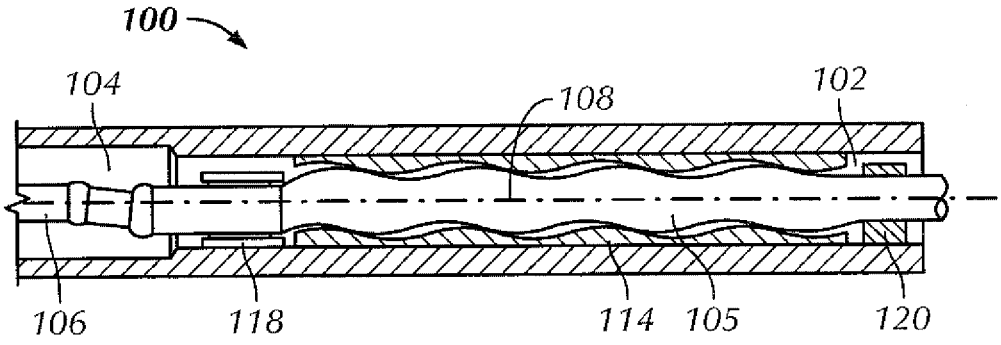

Other examples of various motors (100) using constrained rotors as disclosed herein, such as for use in drilling operations, are illustrated in FIGS. 14-15, where like numerals represent like parts. As illustrated and discussed with respect to FIG. 13, embodiments of motor (100) may includes a constraint (118) proximate outlet (distal) end (104) to constrain the movement of rotor (105). As illustrated in FIG. 14, embodiments of motor (100) may include a constraint (120) proximate inlet (proximal) end (102) to constrain the movement of rotor (105). As illustrated in FIG. 15, embodiments of motor (100) may include constraint (118), (120) proximate inlet end (102) and outlet end (104), respectively, to constrain the movement of rotor (105).

Figure 12B:
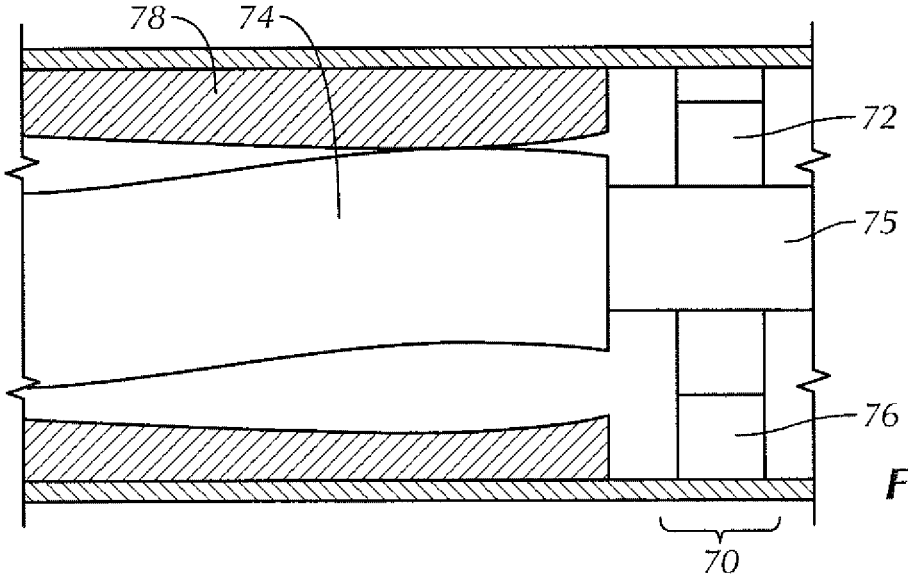
FIG. 12B shows a longitudinal sectional view through part of a moving cavity motor or pump fitted with the apparatus of FIG. 12A.

When two or more constraints are used, such as in FIG. 15, the constraints (118), (120) may be the same or different. For example, as described above, forces imparted on the rotor (105) may be different at the inlet end than they are at the outlet end, resulting in different radii of orbits for the rotor centre at the inlet and outlet ends. Thus, it may be preferable to have a restraint limiting the radial movement of rotor (105) proximate inlet end (102), such as the restraint illustrated in FIG. 5, may work effectively in combination with a restraint limiting the inward radial motion of the rotor, such as the restraint illustrated in FIG. 9 or FIGS. 12A, 12B. In this manner, the restraints may effectively limit the gap size formed between the rotor and stator, improving motor efficiency.

The apparatuses disclosed herein may be used to constrain the radial and/or tangential movement of a rotor relative to a stator, decreasing, minimizing, or eliminating the flow gaps along the length of the motor, thereby improving motor efficiency. Apparatuses disclosed herein may also reduce stator wear.

The embodiments illustrated herein are provided purely by way of example and it will be appreciated that other systems for controlling or limiting the movement of the rotor relative to the stator could also be conceived within the scope of the concepts disclosed herein.

It will also be understood that although the illustrated embodiments have the rotor as a component that revolves within the stator, and indeed most pumps and motors are arranged this way, the embodiments disclosed herein will work equally as well if the inside component is fixed and the outside component rotates.

What is claimed:

1. A method of drilling a wellbore through a subterranean formation, the method comprising:

passing a drilling fluid through a mud motor assembly, the mud motor assembly comprising a progressive cavity motor, the progressive cavity motor comprising:

a stator and a rotor, wherein a surface of the stator is made of a flexible material to permit a seal to form between contacting surfaces of the rotor and the stator, the rotor having a proximal end and a distal end;

a wheel assembly disposed radially-outward from a generally straight portion of the rotor and axially between a helical portion of the rotor and a moveable joint assembly, wherein the moveable joint assembly transforms rotation about an orbiting axis to rotation about a fixed axis, the wheel assembly comprising:

a wheel constrains the radial and/or tangential movement of the rotor relative to the stator, wherein the wheel has one or more apertures permits the flow of fluid therethrough; and a bearing positioned radially between the wheel and the rotor, wherein the bearing permits relative rotation between the wheel and the rotor; and drilling the formation using a drill bit directly or indirectly coupled to the rotor.

2. The method of claim 1, wherein the wheel assembly comprises a wheel aligned with the generally straight portion of the rotor, the wheel being configured to run around an inner surface of the stator.

3. The method of claim 1, wherein the wheel assembly is located at a position in the mud motor assembly where the profile of the rotor and the stator are substantially circular.

4. The method of claim 1, wherein the outside diameter of the wheel is equal to the diameter of the inner surface of the stator minus twice the predetermined maximum offset of the rotor from its geometric centerline.

5. The method of claim 1, wherein engaging surfaces of the rotor and the stator are substantially rigid in the area of the wheel assembly.

6. A mud motor assembly comprising a progressive cavity motor, the progressive cavity motor comprising:

a stator and a rotor, wherein a surface of the stator is made of a flexible material to permit a seal to form between contacting surfaces of the rotor and the stator, the stator and rotor having an inlet end and an outlet end; and a precession device disposed radially-outward from a generally straight portion of the rotor and axially between a helical portion of the rotor and a moveable joint assembly, wherein the moveable joint assembly transforms rotation about an orbiting axis to rotation about a fixed axis, wherein the precession device comprises a lobed wheel coupled to the rotor, wherein the lobed wheel runs on a lobed track coupled to the stator, and wherein the precession device constrains the radial and/or tangential movement of the rotor relative to the stator.

7. The mud motor assembly of claim 6, wherein the generally straight portion of the rotor comprises a shaft which extends beyond the surface of the stator made of the flexible material and is proximate the outlet end.

8. The mud motor assembly of claim 6, wherein an operative area of the precession device is concentric with an operative area of the rotor/stator pair.

9. The mud motor assembly of claim 6, wherein the precession device constrains the orbital path of the rotor relative to the stator.

10. The mud motor assembly of claim 6, wherein the precession device fixes the orbital path of the rotor relative to the stator.

11. The mud motor assembly of claim 6, wherein the precession device limits the movement of a geometric center of the rotor to a predetermined path.

12. The mud motor assembly of claim 6, further comprising a constraining apparatus disposed proximate the outlet end, the constraining apparatus selected from the group consisting of a second wheel assembly having a second wheel coupled to the rotor, a fixed insert fitted inside the stator, a piston assembly having a plurality of pistons coupled to the stator, and a second lobed wheel coupled to the rotor.

13. The mud motor assembly of claim 12, wherein the constraining apparatus and the precession device have different designs.

14. The mud motor assembly of claim 6, wherein the precession device limits the deflection or compression of the flexible material to less than 0.64 mm.

15. The mud motor assembly of claim 6, wherein the precession device limits the deflection or compression of the flexible material to less than 0.38 mm.

16. The mud motor assembly of claim 6, wherein a ratio of the number of lobes on the lobed wheel to the number of lobes on the lobed track is limited to the ratio of the number of lobes on the rotor to the number of lobes on the stator.

17. The mud motor assembly of claim 6, where the precession device is configured to provide at least one of:

optimum sealing of the cavities within the mud motor;

optimum stresses in the different materials comprising the rotor and stator; and a predetermined trajectory and rotation of the rotor.

18. The mud motor assembly of claim 6, where the surface of at least one of the lobed wheel and the lobed track comprises a flexible material.

19. The mud motor assembly of claim 6, wherein axial surfaces of the lobed wheel and lobed track are parallel to the axis of the mud motor assembly.

20. The mud motor assembly of claim 6, wherein an axial gap is present between the precession device and the moveable joint assembly.

21. A method of manufacturing a progressive cavity motor or pump, the method comprising:

disposing an inner member within an outer member, one comprising a stator and the other a rotor; and operatively connecting a lobed wheel of a precession device to the rotor, wherein the lobed wheel runs on a lobed track that is coupled to the stator, wherein the precession device is disposed radially-outward from a generally straight portion of the inner member and axially between a helical portion of the inner member and a moveable joint assembly, wherein the moveable joint assembly transforms rotation about an orbiting axis to rotation about a fixed axis, and wherein the precession device constrains the radial and/or tangential movement of the rotor relative to the stator.

22. The method of claim 21, further comprising molding, machining, and/or spray coating at least one of the inner member and the outer member.

23. A method of manufacturing a progressive cavity motor or pump, the method comprising:

aligning a tubular outer member with a molding, machining, and/or spray coating device; and molding, machining, and/or spray coating a first inner portion of the outer member to have a profiled helical inner surface and at least one second inner portion having an inner surface of approximately constant inner diameter, the second inner portion housing an apparatus that is disposed radially-outward from a generally straight portion of an inner member and axially between a helical portion of the inner member and a moveable joint assembly, wherein the moveable joint assembly transforms rotation about an orbiting axis to rotation about a fixed axis, and wherein the apparatus comprises:

a wheel assembly having a wheel constraining the radial and/or tangential movement of the inner member, wherein the wheel has one or more apertures to permit the flow of fluid therethrough; and a bearing positioned radially between the wheel and the inner member, wherein the bearing permits relative rotation between the wheel and the inner member.

24. A drilling assembly comprising:

a mud motor assembly comprising a progressive cavity motor, comprising:

a stator and a rotor, wherein a surface of the stator is made of a flexible material to permit a seal to form between contacting surfaces of the rotor and the stator; the rotor having a proximal end and a distal end;

at least one apparatus disposed radially-outward from a generally straight portion of the rotor and axially between a helical portion of the rotor and a moveable joint assembly, wherein the moveable joint assembly transforms rotation about an orbiting axis to rotation about a fixed axis, the at least one apparatus including a precession device having a lobed wheel coupled to the rotor for constraining the radial and/or tangential movement of the rotor relative to the stator; and a motor output shaft directly or indirectly coupled to the distal end of the rotor; and a drill bit directly or indirectly coupled to a distal end of the motor output shaft.

25. A progressive cavity motor or pump assembly comprising:

an inner member disposed within an outer member, one comprising a stator and the other a rotor, wherein a surface of the rotor or the stator is made of a flexible material to permit a seal to form between contacting surfaces of the rotor and the stator;

the outer member having a first section with a profiled helical inner surface and at least one second section with a substantially circular inner surface, the at least one second section being proximate at least one of an inlet end and an outlet end;

a wheel assembly disposed radially-outward from a straight portion of the inner member and axially between a helical portion of the inner member and a moveable joint assembly, wherein the moveable joint assembly transforms rotation about an orbiting axis to rotation about a fixed axis, the wheel assembly having a wheel coupled to the rotor for constraining the radial and/or tangential movement of the rotor relative to the stator, and the wheel having one or more apertures to permit the flow of fluid therethrough.

* * * * *